United States Patent [19]

Carrera

[11] 4,324,021

[45] Apr. 13, 1982

[54] DEVICE FOR DISPOSING A CARD ROVING IN A FIXED BOX

[76] Inventor: Angelo Carrera, Via Del Chioso, Trezzo Sull'Adda, Italy

[21] Appl. No.: 122,746

[22] Filed: Feb. 19, 1980

Related U.S. Application Data

[63] Continuation-in-part of Ser. No. 869,162, Jan. 13, 1978, abandoned.

[30] Foreign Application Priority Data

Jan. 13, 1977 [IT] Italy ..... 19251 A/77

[51] Int. Cl.[3] ..... B65H 54/80

[52] U.S. Cl. ..... 19/159 R

[58] Field of Search ..... 19/159 R; 308/DIG. 7, 308/DIG. 8, DIG. 9, 174, 187.1, 241

[56] References Cited

U.S. PATENT DOCUMENTS

| | | | |
|---|---|---|---|
| 2,728,113 | 12/1955 | Watson et al. | 19/159 R |
| 3,001,837 | 9/1961 | Lamson et al. | 308/241 |
| 3,271,826 | 9/1966 | Jackson | 19/159 R |
| 3,355,775 | 12/1967 | Whitehurst | 19/159 R |
| 3,387,340 | 6/1968 | Caldwell et al. | 19/159 R |
| 3,470,587 | 10/1969 | Kincaid | 19/159 R |
| 3,562,864 | 2/1971 | Osgood et al. | 19/159 R |
| 4,236,278 | 12/1980 | Hoover | 19/159 R |
| 4,236,279 | 12/1980 | Kawaura | 19/159 R |

FOREIGN PATENT DOCUMENTS

| | | | |
|---|---|---|---|
| 685844 | 3/1965 | Italy | 19/159 R |

*Primary Examiner*—Louis Rimrodt
*Attorney, Agent, or Firm*—Joseph W. Molasky

[57] ABSTRACT

An improved device for disposing roving in the form of overlying epicycloids inside a fixed box, provided with two sun gears and one planet gear, the planet gear being rotated by the sun gear which is rotated by a gear wheel, and another sun gear coaxial to the first sun gear, being rotated by a worm, wherein each epicycloid gear is centered and in case supported by three pairs of bearings disposed at 120° to each other, the outer ring of the bearing coated with appropriate self-lubricating resin.

11 Claims, 9 Drawing Figures

DEVICE FOR DISPOSING A CARD ROVING IN A FIXED BOX

This is a Continuation-In-Part of Application Ser. No. 869,162, filed Jan. 13, 1978 now abandoned.

This invention relates to an improved device for disposing a roving in the form of overlying epicycloids inside a fixed box, where the roving originates from the exit calenders of cards, combing machines and the like.

BACKGROUND

Italian Pat. No. 685,844, for example, describes a device of the aforesaid type which has been used with advantage by numerous manufacturers. However, this device, which comprises a planet gear and two sun gears, has certain drawbacks, such as:

(1) the danger of the necessary lubrication of the parts subject to sliding friction damaging the roving;
(2) inaccuracy in the centering of the epicyclic gears;
(3) wearing of the epicyclic gear seats by the hardened steel of the bearings;
(4) considerable energy consumption;
(5) noise; and
(6) the need for frequent maintenance.

THE INVENTION

The device of this invention, which also comprises a planet gear and two sun gears, obviates the aforesaid drawbacks and offers further advantages which will be evident from the description of the invention given hereinafter.

Thus, the device according to this invention comprises the hereinafter described special characteristics, which may be adopted separately but, preferably, jointly:

(1) The sliding friction couplings between the sun gears and planet gear are replaced by revolving friction couplings, using ball or roller bearings (i.e. rolling bearings), disposed with their axes vertical, said bearings having an inner ring and an outer ring (or race) as is conventional.
(2) In general a bearing is not required to perform more than one function, i.e., from working simultaneously as a thrust, axial or supporting, and a centering, radial, bearing.
(3) Instead of single bearing, the use of two equivalents is preferred to reduce the overall size of the device.
(4) Bearings are used having an outer ring previously coated with self-lubricating resin, e.g. nylon 66, i.e., poly(hexamethylene adipamide), the bearings being preferably of lubrication sealed type. (Lubrication which could damage the roving is therefore dispensed with, and wear of the epicyclic gear seats and noise are considerably reduced.)
(5) Three pairs of bearings disposed at 120° to each other are used for supporting and centering the planet gear (see bearings 5 and 6 as shown in FIGS. 4 and 5), each pair being provided with a centering bearing and a thrust bearing.
(6) Three pairs of bearings (see bearings 7 as shown in FIG. 3) disposed at 120° to each other are used for supporting the first sun gear which engages with the planet gear, the bearings being arranged to resist downward thrusts and to center said sun gear.

(7) Three pairs of thrust bearings (see bearings 11 as shown in FIG. 6) arranged at 120° to each other are used for supporting the second sun gear, the bearings being arranged to support vertical stresses in both directions.
(8) Three centering bearings (see bearings 12 as shown in FIG. 7) disposed at 120° to each other are used for centering the roving turnplate (see disc 8 as shown in FIG. 2).
(9) Three centering bearings disposed at 120° to each other are used for centering the lower disc (disc 13 as shown in FIG. 2) surrounding the roving turnplate (disc 8 shown in FIG. 2). These bearings need not be coated.
(10) A plate with inwardly inclined raised edges is disposed on the planet gear for collecting the roving waste, dust, etc.
(11) The axial bearings used in this application show a resin coated outer ring tapered outwardly with an angle of 20°–30°. These limits depend on that if the angle is less than 20° the coating wears too quickly, if it is greater than 30° difficulties are encountered in maintaining a good centering action. These effects occur sharply beyond said 20° and 30°.

Of course also the groove in the mating wall is tapered outwardly with the same angle.

This invention will now be illustrated by reference to the Drawings.

DRAWINGS

In FIGS. 1 and 2 certain parts have been partially removed to simplify the Drawings and because they are not necessary for an understanding of the invention.

FIG. 3 shows a thrust and centering bearing 7;

FIG. 4 shows a thrust bearing 5 operating in both directions;

FIG. 5 shows a centering bearing 6;

FIG. 6 shows a thrust bearing 11 operating in both directions;

FIG. 7 shows a centering bearing 12; and

Figure 8:
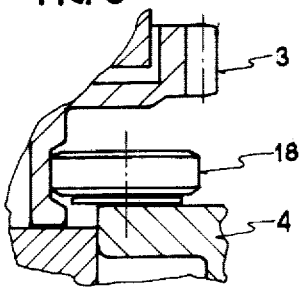

FIG. 8 shows centering bearing 18 cooperating with sun gear 3 and base plate 4.

This invention will now be described by making reference to a precise embodiment; however, it is to be understood that this embodiment is illustrative only and is not intended to be limitative. Therefore, any modification thereof is considered being within the scope of this invention and not a departure therefrom.

DETAILED DESCRIPTION OF THE PREFERRED EMBODIMENT

The planet gear 1 is rotated by sun gear 2 which, in turn, is rotated by the gear wheel 16. The sun gear 3 is rotated by the worm 17 coaxial to the sun gear 2.

Figure 4:
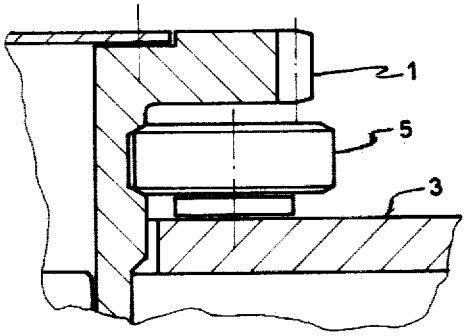
Figure 5:
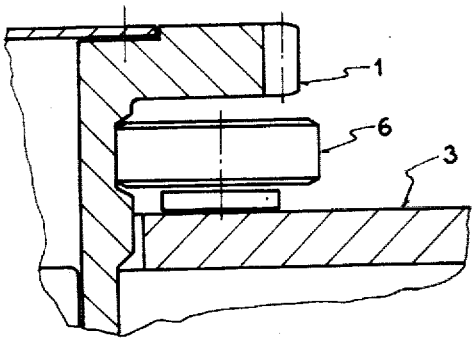

The weight of the planet gear 1 is supported by the sun gear 3 and this latter element is supported by base 4. The planet gear 1 is mounted in its eccentric position relative to sun gear 2 by three pairs of ball bearings 5 and 6, constructed and arranged as shown in FIGS. 4 and 5 so that one bearing (FIG. 5) is a centering bearing and the other (FIG. 4) a thrust bearing.

Figure 3:
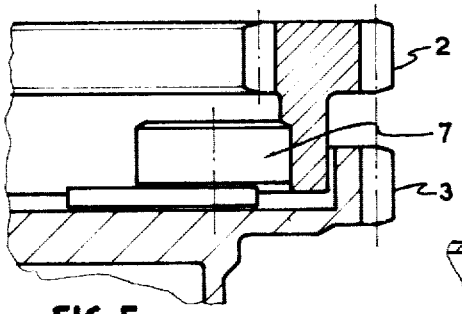
FIGS. 3–8 depict the same resin coated bearings shown in FIGS. 1 and 2, but to a larger scale to better illustrate their function.

The sun gear 2 is centered coaxially relative to the sun gear 3 by three pairs of bearings 7 which are constructed and arranged as shown in FIG. 3 so that they are also able to support downward thrusts. In this particular case, because of the low load speed, the bearings 7 have both a centering and thrust action.

Figure 6:
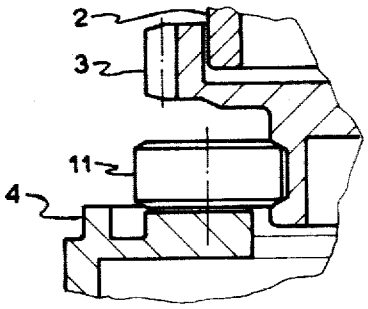

The sun gear 3 is supported relative to the base 4 by three pairs 11 of thrust bearings which are constructed and arranged as shown in FIG. 6 so as to act in both directions.

The planet gear 1 is removably connected lowerly to a disc 8 (or roving turnplate) provided with an aperture 9 in which the tube 10 (through which the roving slide) is fixed. The disc 8 may be replaced by another having its aperture more or less distant from its center to adapt it to boxes of different diameters.

Figure 7:
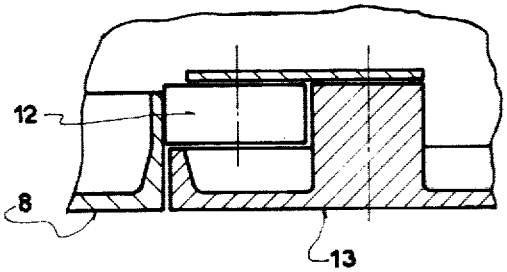

The disc 8 in centered by three pairs of bearings 12 constructed and arranged as shown in FIG. 7 and fixed to the ring 13 and rotating together with the sun gear 3 with which it is rigid.

The ring 13 is centered relative to the base 4 by three bearings 12 disposed at 120° to each other.

The planet gear 1 is closed upperly by a disc 14 and by a ring 15 with lateral walls which effectively prevent dust and cotton waste from clogging the device. The device is furnished with a cap provided with the roving entrance 31, thereabove.

In operation, first sun gear 2 is driven by gear wheel 16 and second sun gear 3 is driven by worm 17 to cause planet gear 1 to rotate about its axis and to revolve around the common rotation axes of sun gears 2 and 3. Accordingly, roving fed into the device through tube 10 is wound in a coiler box (not shown) under disc 8 in the form of epicycloids.

Figure 1:
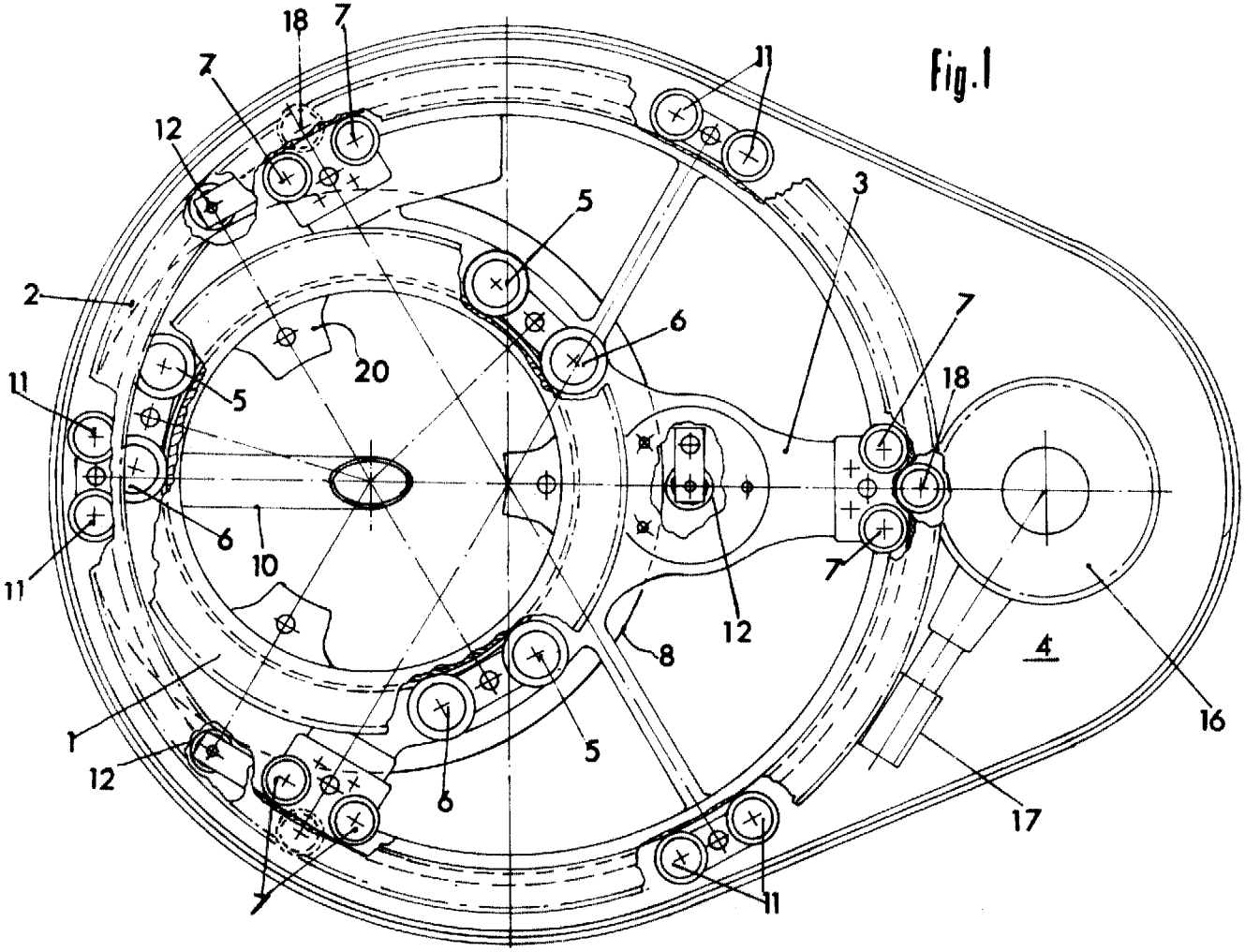
FIG. 1 is a plan view of one half of the device.
Figure 1A:
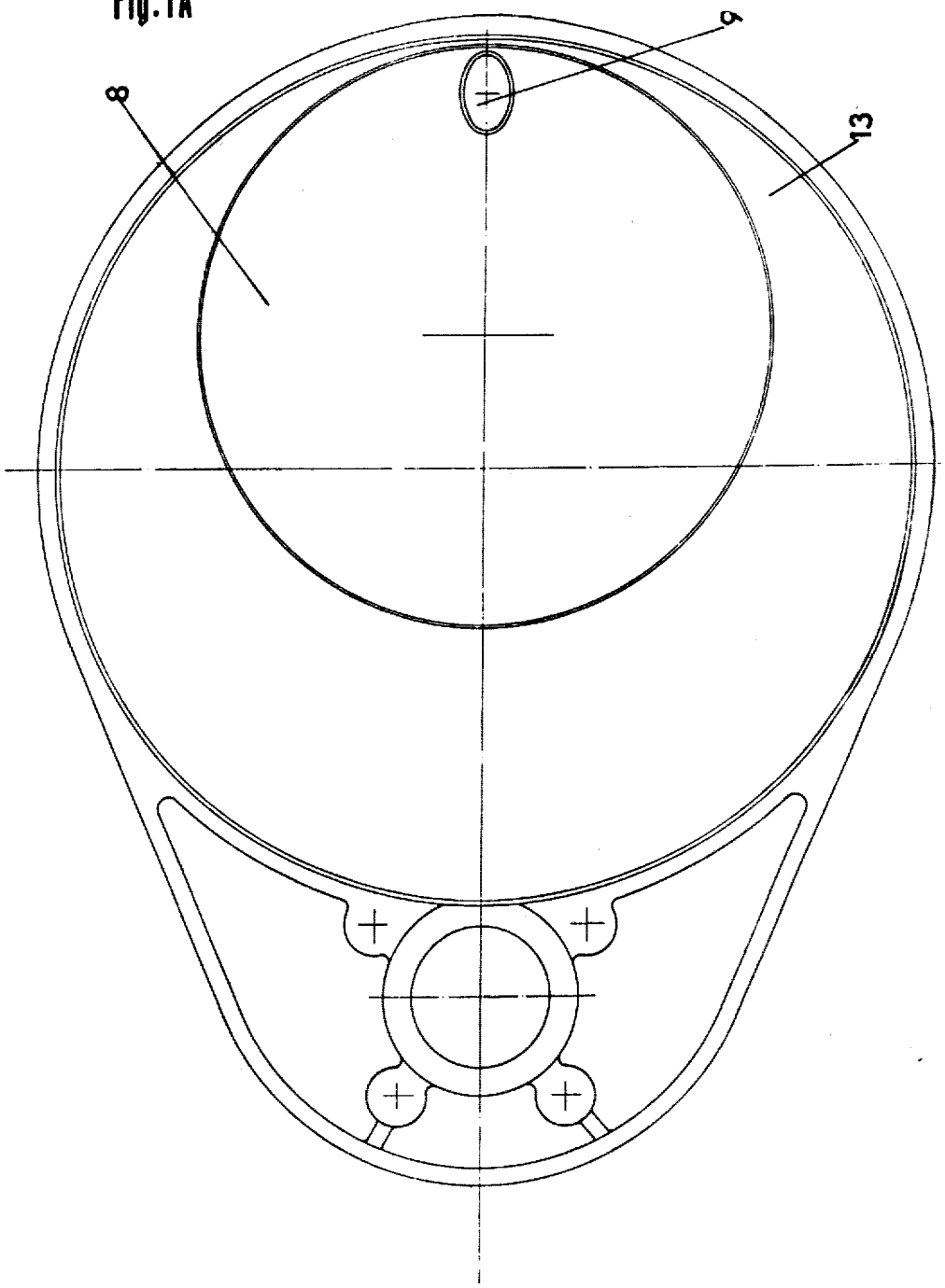
FIG. 1A is an underside view of the device of FIG. 1.
Figure 2:
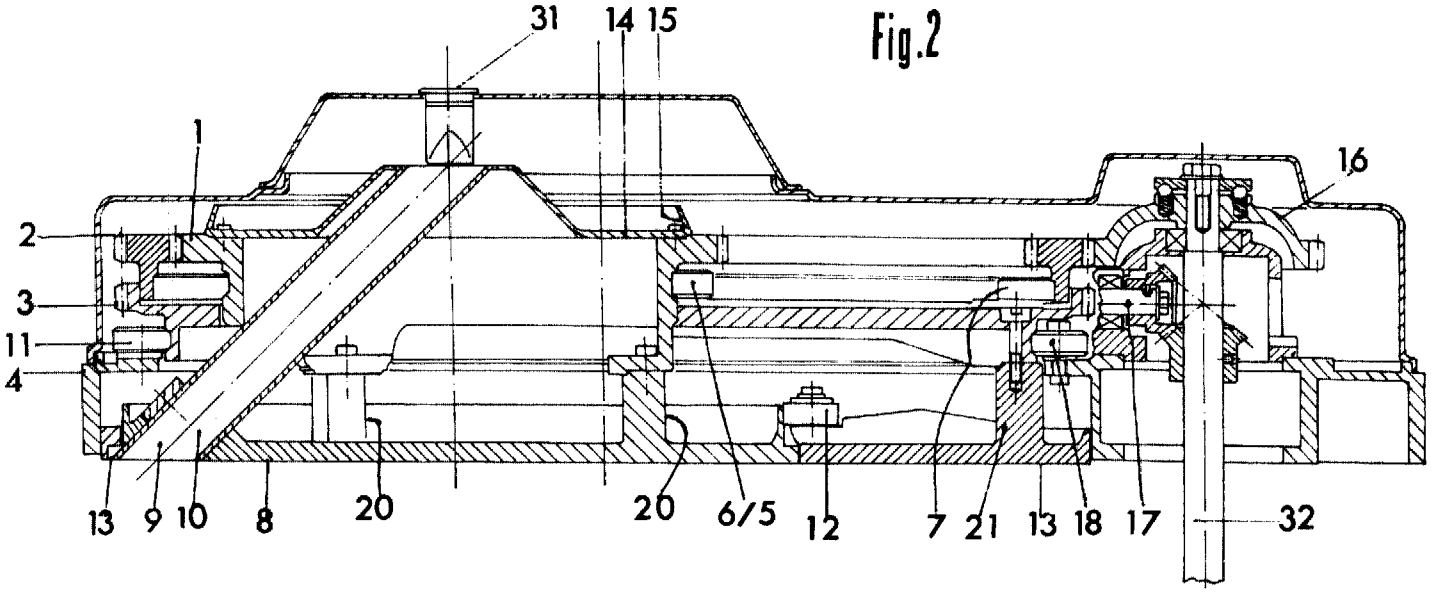
FIG. 2 is a section through the device of FIG. 1 on a vertical plane passing through the axis of symmetry of the device.

Referring to FIGS. 1, 1A and 2, the device of the invention may be considered as comprising planet gear 1 of a relatively small diameter, positioned eccentric with regard to the device, and comprising three parts; namely, a top part being upperly closed by disc 14 provided with tube 10 open at its ends and ring 15 with lateral walls, which effectively prevents dust and cotton waste from clogging the device; an intermediate cylindrical part provided with external toothing; and a bottom part formed by disc 8 provided with aperture 9 for the said tube 10 discharging the roving in the fixed box, not shown. The disc 8 may be replaced by another having its aperture more or less distant from its center to adapt it to boxes of different diameter. The intermediate and the bottom parts are united by three pilasters 20 at 120°. The planet gear 1 is held in its position by three pairs of bearings 5 and 6, see also FIGS. 4 and 5, and by three bearings 12 at 120°. Each pair of bearings 5 and 6 is formed by an axial bearing 5 and a radial bearing 6 whose axes are adjustably fixed on planet 3. Bearings 12 are all radial and their axes are adjustably fixed on sun gear 3.

The device of the invention further comprises a sun gear 2, coaxial with the device and with sun gear 3, formed by a cylinder provided externally and internally with toothing, the external toothing engaging with driving gear 16, the internal toothing engaging with planet gear 1. The sun gear 2 is provided at 120° with three pairs of radial and axial rolling bearings 7 (supporting thrust toward bottom) (see also FIG. 3) whose axes are adjustably fixed with sun gear 3.

Sun gear 3 is coaxial with sun gear 2 and may be considered as built by an externally toothed cylindrical part bolted through three columns 21, only one of which is visible, to a bottom disc 13. The sun gear 3 is provided at 120° with three pairs of axial bearings 11 and with three 120° spaced radial bearings 18, all of these axes being adjustably fixed to the base plate 4. Base plate 4 is fixed, as is usual with devices of this kind, to a shaft 32 driving the mechanism which actuates the gear 16 and worm 17. Under the base plate 4, and arranged coaxially with the device, is positioned the fixed box. The roving is fed in tube 9 and collected as epicycloids in a fixed box.

In the operation of the device, the rotation of gear 16 causes rotation of the sun gear 2 which in turn rotates planet gear 1 about its axis. The contemporaneous rotation of worm 17, which in turn rotates sun gear 3, makes the planet gear 1 revolve about the sun gear axis. Consequently, as is well known in the art, the roving is disposed in the fixed box as an epicycloid as can be seen e.g. on FIG. 2 of U.S. Pat. No. 3,562,864.

As is well known, epicycloidal curves are generated by a point rigidly linked to a circumference (in the present case the roving exit from the device) which rotates without sliding in another circumference (fixed box). It is also known that according to the position of the said point, the epicycloids obtained may be ordinary, shortened and lengthened.

From the above description of the invention it can be appreciated that the usual sliding friction couplings between sun gears and planet gears are replaced by revolving friction couplings and that in order to avoid lubrication, which is apt to damage the roving, the outer rings of the rolling bearings are coated with self-lubricating resins.

Even though the invention has been described with particular reference to the construction illustrated in the Drawings, it is evident that this invention includes all the modifications which would be apparent to the expert skilled in this particular art.

What is claimed is:

1. A device for disposing in a fixed box a roving originated from the exit cylinders of cards comprising as components a planet gear, eccentrically mounted in respect to the fixed box, a first and a second sun gears coaxial with the fixed box, the planet gear being provided with a tube in which the roving is fed to at the tube upper end and discharged, at the tube lower end, according to epicycloidic curves, the rotation of the first sun gear causing the planet gear to revolve about its axis, the rotation of the second sun gear causing the planet gear to revolve about the fixed box axis, characterized by that the planet gear and sun gears show cylindrical vertical surfaces which constitute the tracks for the axial and radial rolling bearings.

2. A device according to claim 1 characterized by that when the track is coupled with an axial rolling bearing then the said cylindrical vertical surface, is at the bottom of a groove whose walls are tapered outwardly with an angle of 20°-30° and the outer ring of the bearing is tapered with same angle.

3. In a device for disposing in a fixed box a roving originating from the exit calenders of cards comprising as components a planet gear, first and second sun gears, and a disc provided with a funnel for the roving, the improvement comprising bearing means for supporting and centering said components in their relative movement of rotation and revolution including a plurality of rolling bearings having outer rings in rolling contact with said components, at least some said rolling bearings having their outer ring coated with a self-lubricating resin.

4. A device according to claim 3 comprising at least one lubrication sealed bearing.

5. A device according to claim 3 wherein said planet gear is centered and supported by three pairs of bearings disposed at 120° to each other, each pair of said bearings including a centering bearing and a thrust bearing, said first sun gear being arranged to engage said planet gear and being centered and supported by three pairs of thrust and centering bearings disposed at 120° to each other, said second sun gear being centered and supported by six pair of bearings disposed at 120° to each other, and including a lower disc surrounding said first-mentioned disc and centered by three bearings disposed at 120° to each other, and a base having said lower disc fixed thereto.

6. A device according to claim 5 wherein each pair of bearings connected to said first sun gear is constituted by a thrust bearing and a centering bearing.

7. A device according to claim 5 wherein the outer rings of all said bearings are coated with a self-lubricating resin.

8. A device according to claim 5 wherein each of said three pairs of bearings supporting said planet gear comprises a centering bearing and a thrust bearing, said planet gear having a circumferentially extending groove, the outer ring of said centering bearing of each pair of bearings supporting said planet gear being received in said circumferentially extending groove in a manner to provide a centering bearing force only to said planet gear, said outer ring of said thrust bearing of each pair of bearings supporting said planet gear being received in said circumferential groove in a manner to provide a thrust bearing force to said planet gear.

9. A device according to claim 8 wherein said outer ring of each of said pair of bearings supporting said planet gear are coated with a self-lubricating resin.

10. A device according to claim 3 wherein one face of said planet gear is closed by a disc provided with a bore for the passage of the roving and by an overlying ring provided with lateral walls for collecting dust.

11. A device according to claim 3 wherein the self-lubricating resin is poly(hexamethylene adipamide).

* * * * *